US008988844B2

(12) United States Patent
Braun et al.

(10) Patent No.: US 8,988,844 B2
(45) Date of Patent: Mar. 24, 2015

(54) DRIVE CIRCUIT FOR AN ELECTROMAGNETIC RELAY

(75) Inventors: Carsten Braun, Berlin (DE); Ronald Stempel, Berlin (DE); Harald Strohmaier, Falkensee (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/996,283

(22) PCT Filed: Dec. 20, 2010

(86) PCT No.: PCT/EP2010/070245

§ 371 (c)(1),
(2), (4) Date: Jun. 20, 2013

(87) PCT Pub. No.: WO2012/084002

PCT Pub. Date: Jun. 28, 2012

(65) Prior Publication Data

US 2013/0279061 A1 Oct. 24, 2013

(51) Int. Cl.

| | |
|---|---|
| ***H01H 47/00*** | (2006.01) |
| ***H01H 47/32*** | (2006.01) |
| ***H01H 47/04*** | (2006.01) |
| ***H01H 47/22*** | (2006.01) |

(52) U.S. Cl.

CPC ..... *H01H 47/32* (2013.01); *H01H 47/04* (2013.01); *H01H 47/22* (2013.01)

USPC ..... 361/190

(58) Field of Classification Search

USPC ..... 361/190

See application file for complete search history.

(56) References Cited

U.S. PATENT DOCUMENTS

| | | | | |
|---|---|---|---|---|
| 6,236,552 | B1 | 5/2001 | Hattori | |
| 6,775,114 | B1 | 8/2004 | Meid et al. | |
| 7,057,870 | B2 * | 6/2006 | Meyer et al. | 361/139 |
| 2005/0047053 | A1 | 3/2005 | Meyer et al. | |

FOREIGN PATENT DOCUMENTS

| | | | |
|---|---|---|---|
| CN | 1358350 | A | 7/2002 |
| CN | 101889323 | A | 11/2010 |
| DE | 19935045 | A1 | 2/2001 |
| EP | 0840342 | A2 | 5/1998 |
| GB | 2273836 | A | 6/1994 |
| WO | 2009062536 | A1 | 5/2009 |

* cited by examiner

*Primary Examiner* — Dharti Patel

(74) *Attorney, Agent, or Firm* — Laurence A. Greenberg; Werner H. Stemer; Ralph E. Locher

(57) ABSTRACT

A drive circuit for an electromagnetic relay having a relay coil and switch contacts, includes a first switching device between a first coil terminal and a first voltage source, a second switching device between a second coil terminal and a zero potential, and a control device producing a current through the coil closing both switching devices. To provide the shortest possible response time and simple and cost-effective construction, a second voltage source is connected through a third switching device to the first coil terminal. The third switching device is connected in parallel with the first switching device, the second voltage source has a higher voltage level than the first voltage source and the control device produces a current through the coil, initially closing all three switching devices and following expiration of a predefined period, opening the third switching device again and keep the first and second switching devices closed.

7 Claims, 2 Drawing Sheets

DRIVE CIRCUIT FOR AN ELECTROMAGNETIC RELAY

BACKGROUND OF THE INVENTION

Field of the Invention

The invention relates to a drive circuit for an electromagnetic relay having a relay coil and switch contacts, comprising a first switching device, which is arranged between a first terminal of the relay coil and a first voltage source, a second switching device, which is arranged between a second terminal of the relay coil and a zero potential, and a control device, which is set up to close both switching devices to produce a current flow through the relay coil.

In electrical devices electromagnetic relays are frequently used to perform controlled switching operations. Electromagnetic relays generally consist of a relay coil and at least one pair of electrical switch contacts. When an electric current flows through the relay coil, a magnetic field is generated around the relay coil, thereby—in so-called self-opening relays—bringing about the closing of the relay contacts, so that a current can flow by way of the relay contacts. When the current flowing through the relay coil is interrupted again, the movable part of the relay contacts is moved back to its initial position, for example by means of a spring device, causing the relay contacts to open and interrupting the current flow by way thereof. With self-closing relays the contacts are closed when the relay coil is currentless and open when current is flowing through.

Electromagnetic relays are generally used when a comparatively large current is to be switched on or off in a switching circuit by means of a comparatively small control current from a drive circuit and/or when galvanic isolation is to be achieved between the drive circuit and the switching circuit. The electromagnetic relay then forms the galvanic decoupling of the drive circuit and the switching circuit.

Electromagnetic relays are used for example in electrical protection devices for monitoring electrical energy supply networks, in order to prompt the triggering of an electric circuit breaker in the event of a fault (e.g. a short circuit) in the electrical energy supply network by closing the relay contacts of a so-called "command relay", thereby interrupting the fault current. A further possible use for electromagnetic relays in protection devices is in so-called binary outputs, where binary communication signals with a high signal level (binary "1") or low signal level (binary "0") can be generated by activating and deactivating relays. When electromagnetic relays are used in such safety-related fields, it is of major importance that unwanted activation or deactivation is reliably prevented, on the one hand to ensure a high level of reliability in the event of a fault and on the other hand to avoid costly false triggering.

The most error-safe embodiment of a drive circuit for an electromagnetic relay possible can be achieved when the relay coil is not only driven by way of a single, in some instances error-prone, switching device but instead by way of two switching devices located in the current path of the relay coil. The relay coil is then only driven when both switching devices are closed at the same time. As soon as one switching device is opened, the current flow through the relay coil is interrupted. This allows a drive operation to be achieved that has a relatively high level of reliability in respect of preventing unwanted activation of the relay coil, as one faulty, permanently short-circuited switching device alone cannot bring about unwanted activation of the relay coil. Such a switching arrangement is known for example from the international patent application WO 2009/062536 A1, which discloses a switching arrangement for driving an electromagnetic relay, in which a relay coil with two switching devices is arranged in a current path in such a manner that one of the switching devices is provided at each of the two terminals of the relay coil. Both switching devices are closed by way of a drive circuit to produce a current flow through the relay coil, while both switching devices are opened to interrupt the current flow.

In some applications it is required of an electromagnetic relay that it has the shortest possible response time in the event of a current flow through the relay coil, in other words a switching operation of the switch contacts of the relay is triggered very quickly. This is required in particular for relays used for binary outputs of electrical protection or control devices, because such binary outputs are used to transfer information to other devices, e.g. further protection or control devices, and the signal transit time should be kept as short as possible here. The time period from the driving of an electromagnetic relay to the final closing of its switch contacts must therefore be as short as possible.

To achieve an electromagnetic relay with the shortest possible response time, it is known for example from the unexamined German application DE 102 03 682 A1 that a semiconductor switch can be used parallel to the switch contacts of the electromagnetic relay, said semiconductor switch having a very fast response time due to the absence of mechanically moved parts and being able to ensure the production of a current flow until the final closing of the switch contacts of the electromagnetic relay. Such a semiconductor switch must in this instance be configured to be able to carry a comparatively large current, as the entire current of the switching circuit must flow by way of the semiconductor switch until the switch contacts of the relay close.

BRIEF SUMMARY OF THE INVENTION

The object of the invention is to specify a drive circuit of the type mentioned above, which on the one hand has the shortest possible response time and on the other hand is structurally simple and can therefore be produced cost effectively.

According to the invention this object is achieved by a generic drive circuit, in which a second voltage source is provided, which is connected by way of a third switching device to the first terminal of the relay coil, the third switching device being connected parallel to the first switching device and the second voltage source having a higher voltage level than the first voltage source, and the control device is set up initially to close all three switching devices to produce a current flow through the relay coil and at the end of a predefined time period to open the third switching device again and to keep the first and second switching devices closed.

The particular advantage of the inventive drive circuit is that just by providing a second voltage source with a higher voltage level than the first voltage source and by using a correspondingly driven third switching device of the relay coil for a short time period it is possible to supply a higher voltage (and therefore to drive a larger current through the relay coil), allowing the prompting of comparatively fast activation of the switch contacts. Once the switch contacts are closed, the voltage level of the first voltage source can be used as a holding voltage, by isolating the second voltage source from the relay coil again by opening the third switching device.

The two voltage sources here can be formed by voltage sources connected separately to the drive circuit or the voltage of a single voltage source can be divided into two voltage levels, the lower voltage level being used for the first voltage source and the higher voltage level being used for the second voltage source. The switching devices can be configured for example as semiconductor switches (transistors, MOSFETs, etc.).

According to one advantageous embodiment of the inventive drive circuit provision is made for the control device to be set up to generate separate switching signals to drive the switching devices, the switching signals being fed to the switching devices by way of mutually isolated signal paths.

This allows multichannel driving of the switching devices, so that an interruption to one of the signal paths does not impact on all the switching devices.

Provision can also be made in this context for signal inverters to be provided either in the signal paths between the control device and the first and third switching devices or in the signal path between the control device and the second switching device, to bring about an inversion of the respective switching signal, and for the control device to be set up to transmit inverse switching signals in each instance by way of the signal paths provided with signal inverters to close the respective switching device.

This advantageously ensures that any influencing of the respective signal paths by any interference from outside, for example an electromagnetic interference, does not impact in the same manner on the switching signals carried in the signal paths, which could thus lead to unwanted activation of the switch contacts of the electromagnetic relay. Instead with this embodiment any interference from outside impacts in a precisely opposing manner on the switching devices at both terminals of the relay coil respectively, so that simultaneous unwanted activation of all the switching devices and the associated production of a current flow through the relay coil are effectively avoided.

In order also to be able to monitor the functionality of both the relay coil and the respective switching devices, according to a further embodiment of the inventive drive circuit it is proposed that electrical resistors be provided parallel to the first and second switching devices, their resistance values being selected so that a current flowing by way of at least one of the resistors and through the relay coil does not bring about any response on the part of the switch contacts of the relay, the control device is set up to emit a sequence of test signals to the respective switching devices, with just one test signal being generated for one switching device respectively at the same time by the control device, and a monitoring device is provided, which is connected on the one hand to a first voltage tap between the relay coil and the first switching device and on the other hand to a second voltage tap between the relay coil and the second switching device and set up to monitor the voltages at the first and second voltage taps.

Provision can be made specifically in this context for the monitoring device to be set up to emit an output signal, which indicates that a respective voltage measured at the first or second voltage tap deviates from a respective comparison voltage.

It is thus possible, with comparatively simple means, to draw conclusions about the functionality of the relay coil and the switching devices by comparing the voltages measured at the respective voltage taps with respective comparison voltages.

According to a further advantageous embodiment of the inventive drive circuit provision can be made in this context for the monitoring device to comprise two comparators, to the respective inputs of which on the one hand the voltage of the respective voltage tap is applied and on the other hand a comparison voltage is applied, the comparators being connected on the output side to an OR element, at the output of which the output signal can be tapped.

This allows the monitoring device for the drive circuit to be achieved with comparatively simple electronic components in the form of two comparators and an OR element.

BRIEF DESCRIPTION OF THE SEVERAL VIEWS OF THE DRAWING

The invention is described in more detail below with reference to an exemplary embodiment. In the drawing

DESCRIPTION OF THE INVENTION

Figure 1:
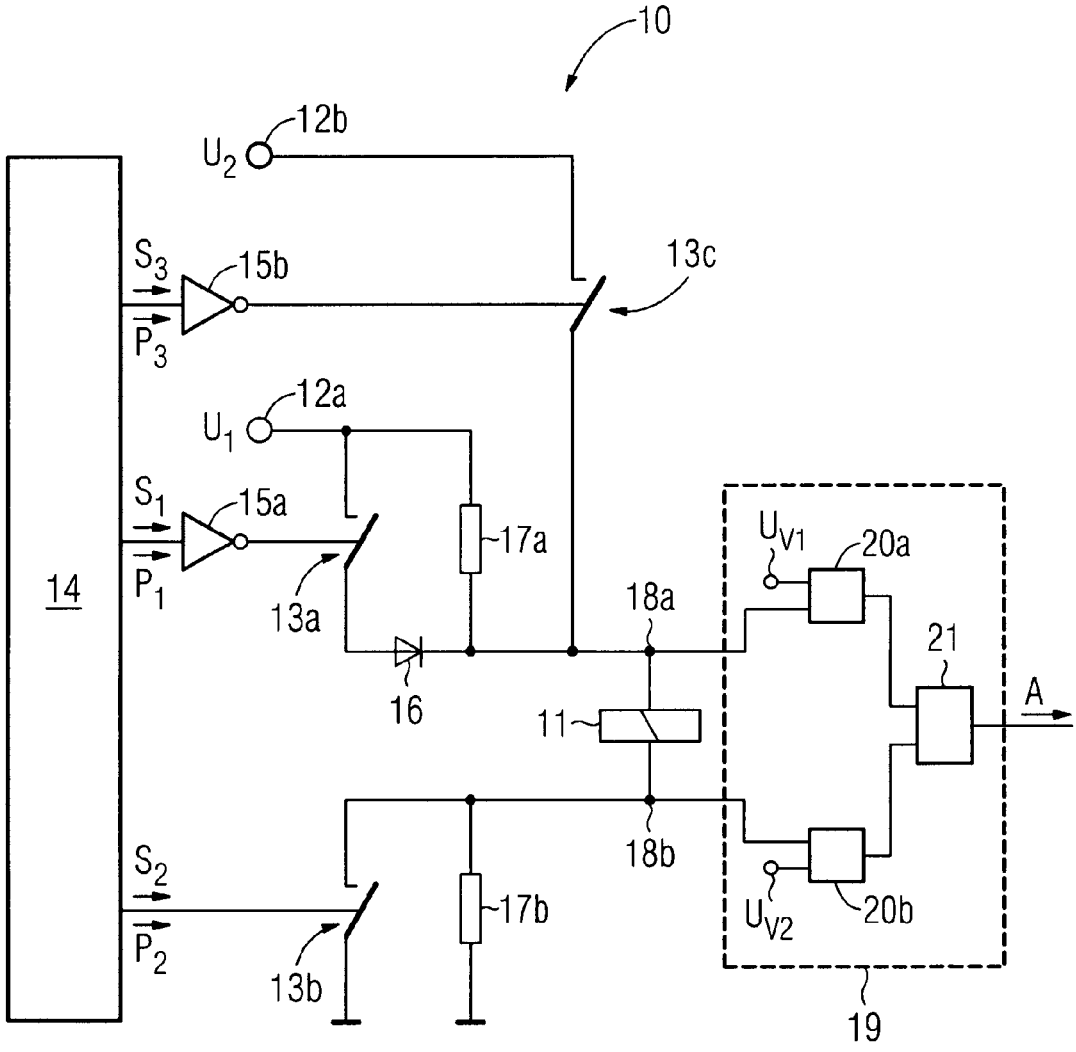
FIG. 1 shows a basic circuit diagram of an exemplary embodiment of a drive circuit for an electromagnetic relay.

FIG. 1 shows a basic circuit diagram of a drive circuit 10 for an electromagnetic relay, of which only the relay coil 11 is shown in FIG. 1 for greater clarity. The electric relay also has switch contacts (not shown in FIG. 1), which can be prompted to perform a switching operation in the presence of a current flow through the relay coil 11. Such switch contacts can be used for example as switch contacts of a command relay for driving a circuit breaker or as switch contacts of a binary communication output of electrical protection devices for monitoring and controlling electrical energy supply networks.

Arranged between a first voltage source 12*a* at voltage level $U_1$ and the relay coil 11 is a first switching device 13*a*. A second switching device 13*b* is also present in the current path between the relay coil 11 and zero potential. A second voltage source 12*b* at voltage level $U_2$ is also provided, connected to the relay coil 11 by way of a third switching device 13*c*, which is connected parallel to the first switching device 13*a*. The switching devices 13*a*, 13*b*, 13*c* can be for example semiconductor switches, e.g. transistors.

A control device 14 serves to drive the switching devices 13*a*, 13*b* and 13*c*. The control device can consist—as shown in FIG. 1—of a single logic circuit, for example a correspondingly programmed ASIC or FPGA; in contrast to the diagram according to FIG. 1 however the control device 14 can also consist of respectively separate logic circuits assigned to the individual switching devices 13*a*, 13*b*, 13*c*.

To drive the switching devices 13*a*, 13*b*, 13*c*, switching signals $S_1$, $S_2$, $S_3$ are generated by the control device 14, the switching signal $S_1$ being provided to drive the first switching device 13*a*, the switching signal $S_2$ being provided to drive the second switching device 13*b* and the switching signal $S_3$ being provided to drive the third switching device 13*c*. The switching signals $S_1$, $S_2$, $S_3$ are fed to the respective switching devices 13*a*, 13*b*, 13*c* by way of mutually isolated separate signal paths to achieve multiple channels and therefore independence of the individual switching signals and to prevent a possibly unwanted switching operation of the electromagnetic relay being performed if one of the switching signals fails or a signal path is interrupted. Signal inverters 15*a* and 15*b* are also provided in the signal paths of the switching signals $S_1$ and $S_3$, which lead from the control device 14 to the first and third switching devices 13*a* and 13*c*, to bring about an inversion of the switching signal $S_1$ or $S_3$ emitted respectively by the control device 14 and forward a correspondingly inverse switching signal to the respective switching device 13*a* or 13*c*. Inversion of the switching signals here means a reversal of the signal level of a binary switching signal, so that a switching signal that has a high signal level (binary "1") before inversion is converted to a switching signal with a low signal level (binary "0") after inversion and vice versa. Provision of the signal inverters 15*a* and 15*b* for signal inversion of the switching signals $S_1$ and $S_3$ serves to minimize a damaging influence of external interference, produced for example by electromagnetic influences of the drive circuit, which could otherwise be coupled in an identical manner into the signal paths of the switching signals $S_1$, $S_2$, $S_3$ and could produce unwanted driving of the relay coil. The signal inverters 15*a*, 15*b* allow such identical influencing of the signal paths of the switching signals $S_1$, $S_2$, $S_3$ to be largely prevented, as external interference would always impact in a converse manner on the first and third switching devices 13*a*, 13*c* on the one hand and the second switching device 13*b* on the other hand due to signal inversion.

Figure 2:
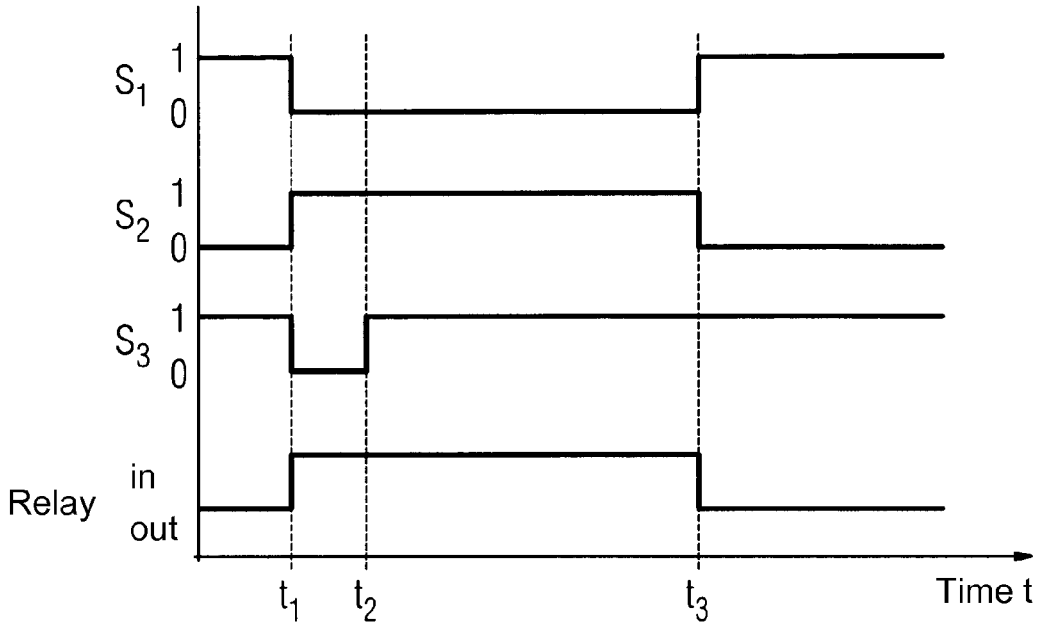
FIG. 2 shows a diagram to explain the switching profile of switching signals for driving an electromagnetic relay.

The mode of operation of the drive circuit 10 when driving the relay coil 11 is described in more detail below with reference to FIG. 2. For this purpose FIG. 2 shows a diagram illustrating the signal profiles of the switching signals $S_1$, $S_2$, $S_3$ for the switching devices 13*a*, 13*b*, 13*c* and the corresponding response of the switch contacts ("relay on/off") driven by the relay coil 11.

Before a first time point designated as $t_1$ a first switching signal $S_1$ with a high signal level, a second switching signal $S_2$ with a low signal level and a third switching signal $S_3$ with a high signal level are emitted by the control device 14 to the respective switching devices 13*a*, 13*b*, 13*c*. The signal inverters 15*a*, 15*b* invert the first switching signal $S_1$ and the third switching signal $S_3$ as described above and feed them in such an inverted form to the switching devices 13*a* and 13*c*, so that a switching signal with a low signal level is ultimately fed to all three switching devices 13*a*, 13*b*, 13*c* before the first time point $t_1$, so that all three switching devices remain in the opened position. The switch contacts of the relay are correspondingly in the deactivated state before time point $t_1$, as can be seen from the lower profile of the diagram.

At time point $t_1$ the three switching devices 13*a*, 13*b*, 13*c* are prompted to activate by a corresponding change in the signal levels of the switching signals $S_1$, $S_2$, $S_3$. This means specifically that at time point $t_1$ both the first and third switching signals $S_1$, $S_3$ take on a low signal level while the second switching signal $S_2$ takes on a high signal level at time point $t_1$. The inversion of the switching signals $S_1$ and $S_3$ means that from time point $t_1$ switching signals with a high signal level are fed to all three switching devices 13*a*, 13*b*, 13*c* so that all the switching devices 13*a*, 13*b*, 13*c* are activated.

This produces a current flow through the relay coil 11, which ultimately brings about activation of the switch contacts of the electromagnetic relay. As this current flow occurring at time point $t_1$ is produced by the second voltage source 12*b* with the higher current level $U_2$ due to the activated third switching device 13*c*, said current is comparatively large when the relay is activated at time point $t_1$ and brings about accelerated closing of the switch contacts, in that the relay coil 11 generates a relatively powerful magnetic field corresponding to the comparatively large current flow, serving to activate the switch contacts of the electromagnetic relay quickly. A diode 16 prevents a current flow from the high voltage level $U_2$ to the lower voltage level $U_1$ of the first voltage source 12*a*.

At the end of a predefined time period, which is based in particular on the activation time of the relay and is in the order of several milliseconds, at time point $t_2$ the control device 14 changes the signal level of the third switching signal $S_3$, with the result that the third switching device 13*c* is prompted to deactivate. After deactivation of the third switching device 13*c* only the lower voltage level $U_1$ of the first voltage source 12*a* is still present at the relay coil 11, ensuring a continued current flow through the relay coil 11 and therefore continued activation of the switch contacts of the relay. As the relay contacts have already been activated in an accelerated manner at this time point, the lower voltage level $U_1$ is sufficient to maintain the current flow through the relay coil 11.

At time point $t_3$ the control device 14 changes the signal levels of the first and second switching signals $S_1$ and $S_2$, so that the first and second switching devices 13*a* and 13*b* are also deactivated and the current flow through the relay coil (largely) ceases. The switch contacts of the electromagnetic relay are therefore opened from time point $t_3$.

With the drive circuit 10 according to FIG. 1, in addition to activating the switch contacts of the electromagnetic relay in an accelerated manner it is also possible to monitor the functionality of the three switching devices 13*a*, 13*b*, 13*c* and the relay coil 11. Two resistors 17*a* and 17*b* are provided for this purpose, being respectively connected parallel to the first switching device 13*a* and the second switching device 13*b*, so that a current flow is permanently produced through the relay coil 11 and the two resistors 17*a* and 17*b* due to the voltage level $U_1$ of the first voltage source 12*a*. However so that this current flow does not bring about unwanted activation of the switch contacts of the electromagnetic relay, the resistance values of the resistors 17*a* and 17*b* are dimensioned so that the current flow flowing through the relay 11 is too small to bring about activation of the switch contacts of the electromagnetic relay.

The resistors 17*a* and 17*b* cause defined voltage levels to be set at voltage taps 18*a* and 18*b*, which are present at both sides of the relay coil 11, when the switching devices 13*a*, 13*b*, 13*c* are deactivated, as the fixed resistors 17*a*, 17*b* and the ohmic resistance value of the relay coil 11 then form a three-part voltage splitter, which sets the voltage levels at the voltage taps 18*a* and 18*b* unambiguously.

A monitoring device 19 is connected to the voltage taps 18*a* and 18*b*, measuring the voltages present at the voltage taps 18*a* and 18*b* and monitoring for deviations and generating an output signal A on the output side, which indicates whether at least one of the voltages at the voltage taps 18*a* and 18*b* deviates from the voltage levels set by the resistors 17*a* and 17*b*.

The monitoring device 19 can be formed specifically from two comparators 20*a* and 20*b* and a logic OR element 21. The voltage measured at the first voltage tap 18*a* is fed to the input side of the first comparator 20*a*. A comparison voltage $U_{V1}$ is also fed to a comparison input of the first comparator 20*a*, its value corresponding to the voltage set at the first voltage tap 18*a* by the resistors 17*a* and 17*b* when the switching devices 13*a*, 13*b*, 13*c* are open. Correspondingly the voltage measured at the second voltage tap 18*b* is fed to the input side of the second comparator 20*b*. A comparison voltage $U_{V2}$ is also fed to a comparison input of the second comparator 20*b*, its value corresponding to the voltage set at the second voltage tap 18*b* by the resistors 17*a* and 17*b* when the switching devices 13*a*, 13*b*, 13*c* are open. Both comparators 20*a*, 20*b* are connected to the logic OR element 21 on the output side.

The first comparator 20*a* emits a signal on the output side when there is a deviation between the voltage present at the first voltage tap 18*a* and the first comparison voltage $U_{V1}$. The second comparator 20*b* emits a signal on the output side when there is a deviation between the voltage present at the second voltage tap 18*b* and the second comparison voltage $U_{V2}$. The first comparator 20*a* is preferably embodied as an inverting comparator and the second comparator 20*b* as a non-inverting comparator. Both comparison voltages $U_{V1}$ and $U_{V2}$ can then be embodied as positive and at the same time voltages at the voltage taps 18*a* and 18*b* that are greater and smaller than the comparison voltages $U_{V1}$ and $U_{V2}$ can be monitored.

The OR element 21 emits an output signal on the output side when at least one of the signals of the comparator indicates that the measured voltage deviates from the respective reference voltage.

To monitor the functionality of the switching devices 13*a*, 13*b*, 13*c*, the control device 14 generates short test signals $P_1$, $P_2$ and $P_3$ to the switching devices 13*a*, 13*b*, 13*c* by way of the signal paths of the switching signals. These do not overlap in respect of time and they prompt their corresponding switching device 13*a*, 13*b*, 13*c* to activate briefly. The duration of the test signal emission is typically several milliseconds.

The procedure for monitoring the switching devices 13*a*, 13*b* and 13*c* will be explained below with reference to FIG. 3. To this end FIG. 3 shows a diagram illustrating the profile of the signal sequence of test signals $P_1$, $P_2$ and $P_3$ emitted by the control device 14 and the corresponding profile of the output signal A emitted by the monitoring device 19.

Monitoring can only take place when the relay coil 11 is deactivated. The control device 14 then generates the test signal $P_1$ as the first test signal of a test signal sequence and feeds it to the first switching device 13*a*. As the signal inverter 15*a* is arranged in the signal path to the first switching device 13*a*, the test signal $P_1$ must therefore have a low signal level to bring about activation of the first switching device 13*a* after its inversion. Activation of the first switching device 13*a* causes the resistor 17*a* to be bridged, so the voltage level at the first voltage tap 18*a* is raised to the voltage level $U_1$ of the first voltage source 12*a*. The voltage level at the second voltage tap 18*b* changes correspondingly so that both comparators 20*a* and 20*b* then generate a signal on the output side and the output signal A of the monitoring device 19 correspondingly indicates that the measured voltage levels deviate from the comparison voltages. This output signal A can be fed to an evaluation unit (not shown in FIG. 1), which also has knowledge of the emission of the first test signal $P_1$ and concludes that the first switching device is functional when the output signal A occurs in response to the first test signal $P_1$. The evaluation unit can also be integrated in the control device 14.

The test signals $P_2$ and $P_3$ are generated correspondingly as further test signals of the test signal sequence emitted by the control device 14 and fed to their respective switching devices 13*b* and 13*c*. Each of these test signals $P_2$ and $P_3$ produces a change in the voltage levels at the voltage taps 18*a* and 18*b* when the switching device 13*b* or 13*c* is functional, so that a corresponding output signal A is emitted by the monitoring device 19 in response and fed to the evaluation unit, which thus identifies the functionality of the switching devices.

Figure 3:
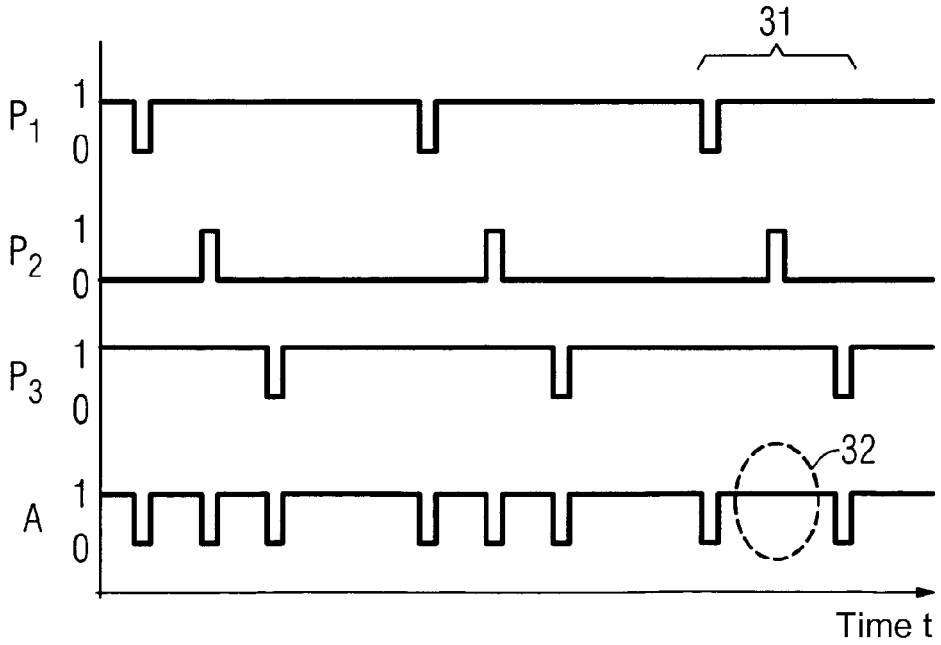
FIG. 3 shows a diagram to explain the profile of test signals for monitoring a drive circuit for an electromagnetic relay.

FIG. 3 shows the instance of a non-functional second switching device 13*b* in the third test signal sequence 31. Because the second switching device 13*b* is faulty, the second test signal $P_2$ does not bring about activation and there is therefore no change in the voltage levels at the voltage taps 18*a* and 18*b*. No output signal A is therefore generated to indicate a deviation from the comparison voltages. The evaluation unit identifies that the expected response of the output signal A to the test signal $P_2$ has not occurred (point 32 in FIG. 3) and therefore concludes that the second switching device 13*b* is faulty. A user of the drive circuit 10 (e.g. the user of a protection device in which the drive circuit is incorporated) can be notified of this for example in the form of an alarm signal or a failure message.

The instance of a faulty relay coil 11 can also be identified by the monitoring facility 19. In this instance a wire break in the relay coil 11 means that current cannot flow by way of the relay coil 11, so the voltage levels at the voltage taps 18*a* and 18*b* deviate permanently from their comparison voltages. A bridging of windings of the relay coil 11, for example due to faulty insulation of the windings, also causes the resistance value of the relay coil 11 to change, which is reflected in permanently changed voltage levels at the voltage taps 18*a* and 18*b* and can therefore also be identified.

The invention claimed is:

1. A drive circuit for an electromagnetic relay having switch contacts and a relay coil with first and second terminals, the drive circuit comprising:

a first voltage source and a second voltage source, said second voltage source having a higher voltage level than said first voltage source;

a first switching device disposed between the first terminal of the relay coil and said first voltage source;

a second switching device disposed between the second terminal of the relay coil and a zero potential;

a third switching device connected between said second voltage source and the first terminal of the relay coil, said third switching device connected parallel to said first switching device; and a control device configured to initially close said first, second and third switching devices to produce a current flow through the relay coil and to open said third switching device again and keep said first and second switching devices closed at an end of a predefined time period.

2. The drive circuit according to claim 1, wherein said control device is configured to generate separate switching signals to drive said first, second and third switching devices, said switching signals being fed to said first, second and third switching devices by way of mutually isolated signal paths.

3. The drive circuit according to claim 2, which further comprises:

signal inverters provided either in said signal paths between said control device and said first and third switching devices or in said signal path between said control device and said second switching device, to bring about an inversion of the respective switching signal; and said control device being configured to transmit inverse switching signals in each instance by way of said signal paths provided with said signal inverters to close said respective switching device.

4. The drive circuit according to claim 1, which further comprises:

electrical resistors each connected parallel to a respective one of said first and second switching devices, said electrical resistors having resistance values selected to cause a current flowing by way of at least one of said resistors and through the relay coil not to bring about any response by the switch contacts of the relay;

said control device being configured to emit a sequence of test signals to said respective switching devices, with just one of said test signals being generated for a respective one of said switching devices at the same time by said control device;

a first voltage tap connected between the relay coil and said first switching device and a second voltage tap connected between the relay coil and said second switching device; and a monitoring device connected to said first voltage tap and to said second voltage tap and configured to monitor voltages at said first and second voltage taps.

5. The drive circuit according to claim 4, wherein said monitoring device is configured to emit an output signal indicating that a respective voltage measured at said first or second voltage tap deviates from a respective comparison voltage.

6. The drive circuit according to claim 4, wherein:

said monitoring device includes two comparators each having an output, one input receiving the voltage of a respective one of said voltage taps and another input receiving a comparison voltage; and said monitoring device includes an OR element connected to said outputs of said comparators and having an output at which said output signal can be tapped.

7. A drive circuit for an electromagnetic relay having switch contacts and a relay coil with first and second terminals, the drive circuit comprising:

a first voltage source and a second voltage source, said second voltage source having a higher voltage level than said first voltage source;

a first switching device disposed between the first terminal of the relay coil and said first voltage source;

a second switching device disposed between the second terminal of the relay coil and a zero potential;

a third switching device connected between said second voltage source and the first terminal of the relay coil, said third switching device connected parallel to said first switching device;

electrical resistors each connected parallel to a respective one of said first and second switching devices, said electrical resistors having resistance values selected to cause a current flowing by way of at least one of said resistors and through the relay coil not to bring about any response by the switch contacts of the relay;

a first voltage tap connected between the relay coil and said first switching device and a second voltage tap connected between the relay coil and said second switching device;

a control device configured to initially close said first, second and third switching devices to produce a current flow through the relay coil and to open said third switching device again and keep said first and second switching devices closed at an end of a predefined time period, said control device being configured to emit a sequence of test signals to said respective switching devices, with just one of said test signals being generated for a respective one of said switching devices at the same time by said control device; and a monitoring device connected to said first voltage tap and to said second voltage tap and configured to monitor voltages at said first and second voltage taps, said monitoring device including two comparators each having an output, one input receiving the voltage of a respective one of said voltage taps and another input receiving a comparison voltage, and said monitoring device including an OR element connected to said outputs of said comparators and having an output at which said output signal can be tapped.

* * * * *